US006340151B1

(12) United States Patent
Snow

(10) Patent No.: US 6,340,151 B1
(45) Date of Patent: Jan. 22, 2002

(54) FENCE CORNERPOST ASSEMBLY BRACKETS

(76) Inventor: Jimmy D. Snow, 5008 Colfax Pl., Oklahoma City, OK (US) 73112

( * ) Notice: Subject to any disclaimer, the term of this patent is extended or adjusted under 35 U.S.C. 154(b) by 0 days.

(21) Appl. No.: 09/711,286

(22) Filed: Nov. 9, 2000

Related U.S. Application Data

(60) Provisional application No. 60/164,725, filed on Nov. 12, 1999.

(51) Int. Cl.[7] ..... E04H 17/14
(52) U.S. Cl. ..... 256/65; 256/64
(58) Field of Search ..... 256/59, 65, 60, 256/64, 68, 35, 66; 403/205, 403

(56) References Cited

U.S. PATENT DOCUMENTS

| | | | | | |
|---|---|---|---|---|---|
| 4,101,226 | A | | 7/1978 | Prisien | |
| 4,266,757 | A | | 5/1981 | Kirkwood | |
| 4,349,181 | A | | 9/1982 | Asher et al. | |
| 4,767,232 | A | * | 8/1988 | Francis | 256/67 X |
| 4,889,322 | A | * | 12/1989 | Wagner | 256/64 X |
| 4,986,513 | A | * | 1/1991 | Schultz et al. | 256/65 |
| 5,139,235 | A | | 8/1992 | Kilmer | |
| 5,192,055 | A | | 3/1993 | Griggs et al. | |
| 5,460,344 | A | * | 10/1995 | Malloy | 248/156 |
| 5,738,342 | A | | 4/1998 | Van Winkle | |
| 6,053,481 | A | * | 4/2000 | Scheide | 256/65 |

* cited by examiner

*Primary Examiner*—Harry C. Kim
(74) *Attorney, Agent, or Firm*—Randal D. Homburg

(57) ABSTRACT

The invention is a set of components for the placement and support of vertical cornerposts and vertical fence posts having a shoe component, a saddle component, a tie component, a draw wire and a cinch bracket. It is provided in several dimensions to accommodate posts of differing circumference.

3 Claims, 5 Drawing Sheets

FENCE CORNERPOST ASSEMBLY BRACKETS

CROSS REFERENCE TO RELATED APPLICATIONS

Provisional Utility Patent Application No. 60/164,725 filed on Nov. 12, 1999.

I. BACKGROUND OF THE INVENTION

1. Field of the Invention

The invention is a set of components for the placement and support of vertical cornerposts or vertical fence posts having a shoe component, a saddle component, a tie component, a draw wire and a cinch bracket. It is provided in several dimensions to accommodate posts of differing circumference.

2. Description of Prior Art

The following U.S. Patents cited and disclosed herein are incorporated within this provisional patent application. They represent prior art which demonstrates the novelty and unique characteristics of the present invention over such prior art.

U.S. Pat. No. 5,738,342 to Van Winkle, discloses a cornerpost arrangement having pre-milled fencing components which interlock using a notch and tongue groove assembly. U.S. Pat. No. 5,192,055 to Griggs, discloses a T-post brace assembly which inserts over the T-post and angularly braces the T-post for lateral support. In U.S. Pat. No. 5,139,235 to Kilmer, an augured base fencepost support bracket is disclosed.

A cornerpost assembly having buried plates for vertical and angled enforcement are disclosed in U.S. Pat. No. 4,349,181 to Asher. Fence post clips providing insertion for attachment of horizontal fencing rails is disclosed in U.S. Pat. No. 4,266,757 to Kirlwood, and a bolted fence rail fastener is disclosed in U.S. Pat. No. 4,101,226 to Parisien.

II. SUMMARY OF THE INVENTION

The primary objective of the current invention is to provide a series of components which are incorporated into a cornerpost or stretchpost assembly for use with generally round or square fencing materials of wood, metal or other tubular composition. Three major pre-formed and angled components are provided; the shoe component, saddle component and a tie component. A draw wire and a cinch bracket are also included in the invention. This arrangement may be utilized with or without independently fastening the three major components to the fencing materials, and provide stable lateral support to the corner or stretch posts. Another objective of this assembly utilization is that it allows for the setting and erection of the corner or stretch post by one-person.

III. DESCRIPTION OF THE DRAWINGS

The following drawings are formal drawings submitted with this utility patent application.

Figure 1:
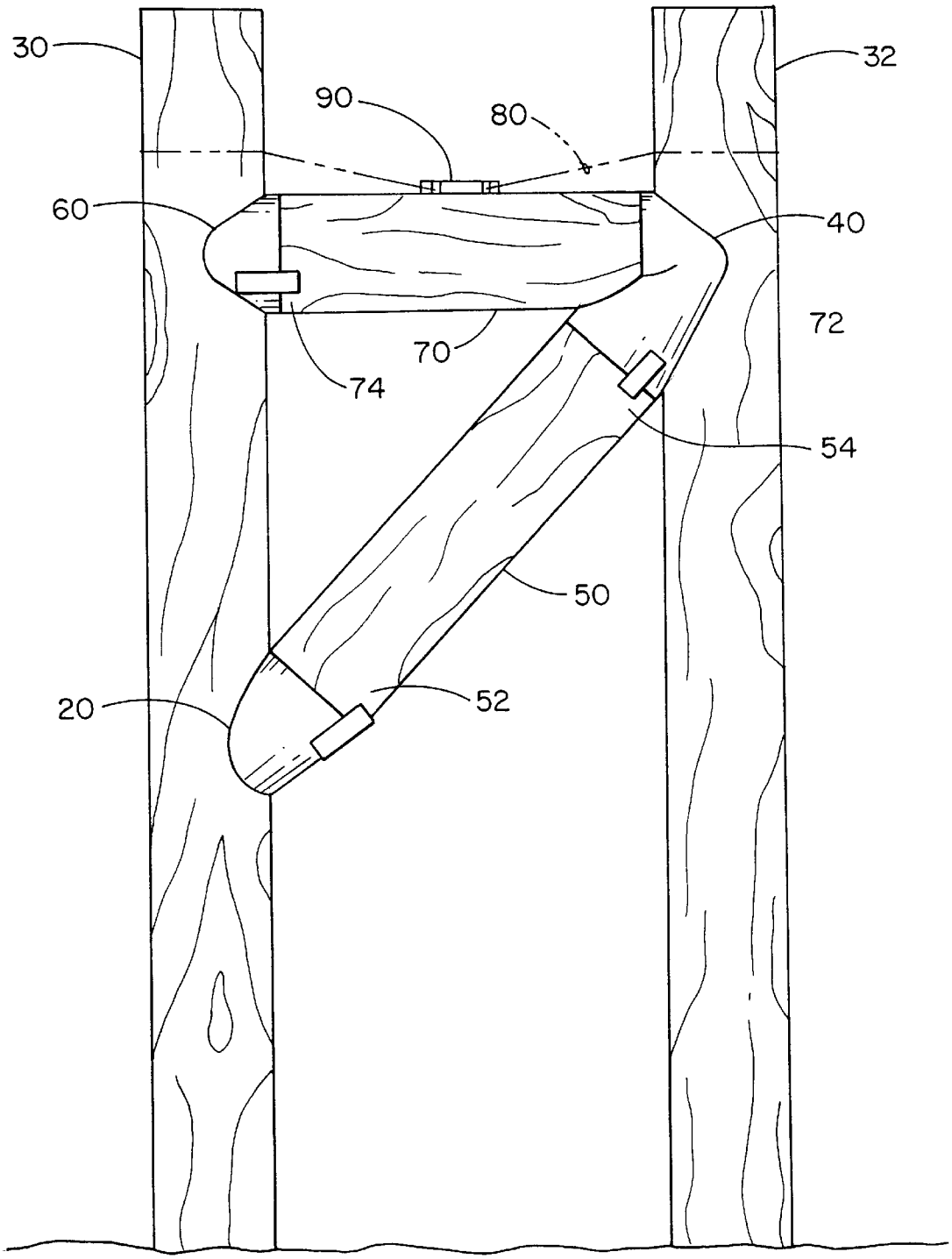
Figure 2A:
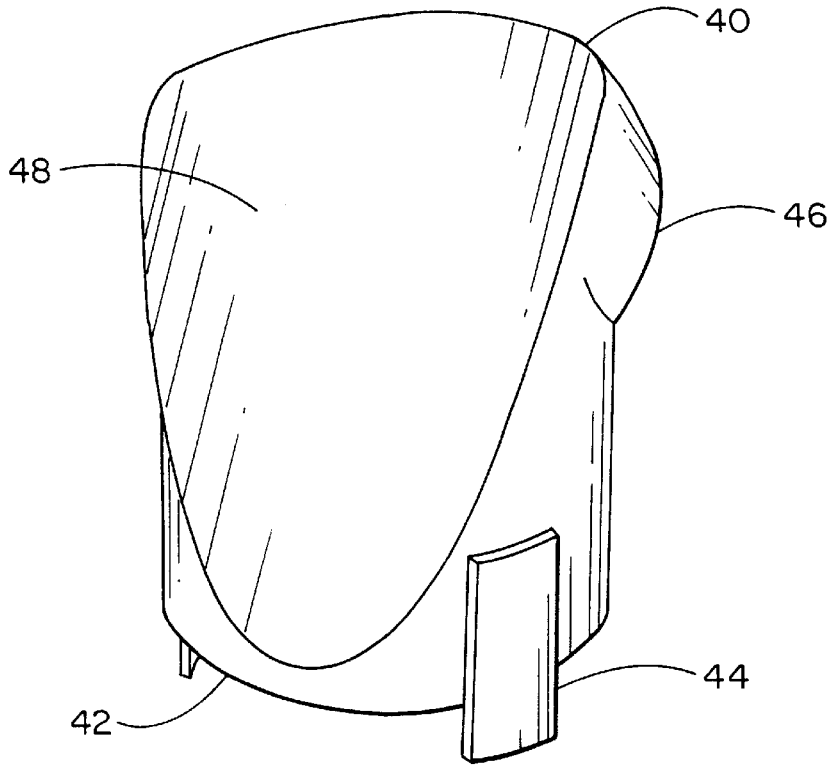
Figure 2B:
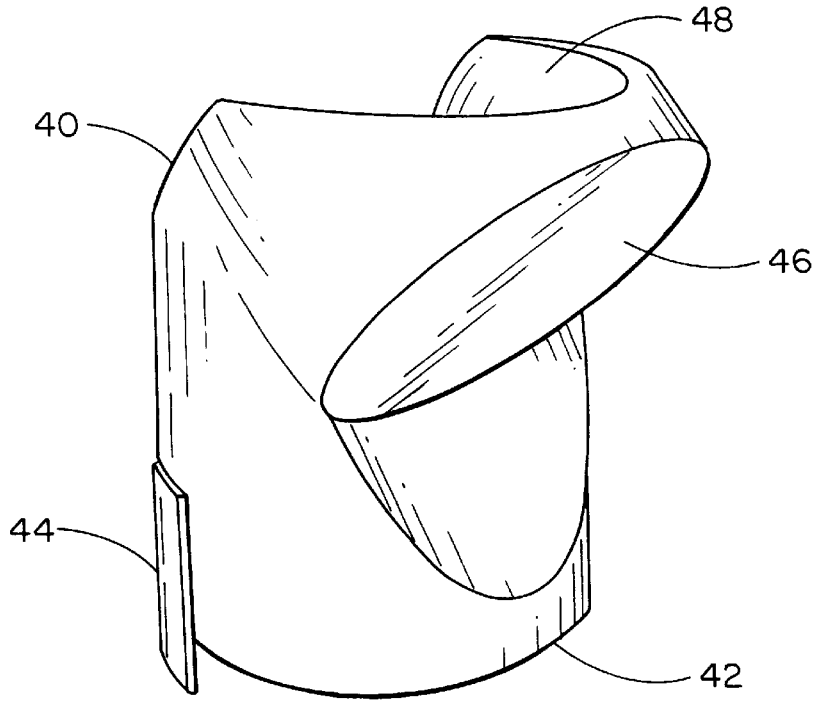
Figure 2C:
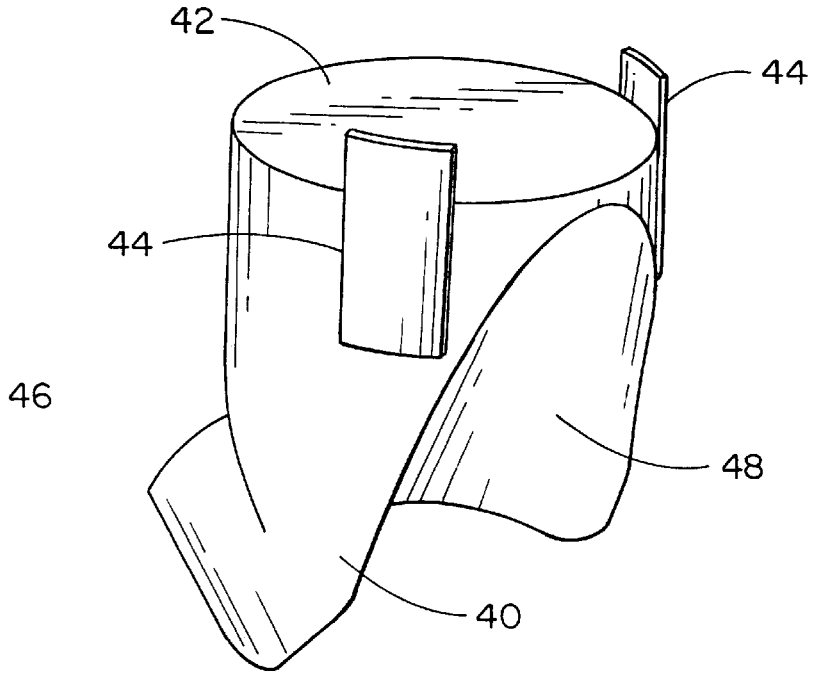
Figure 2D:
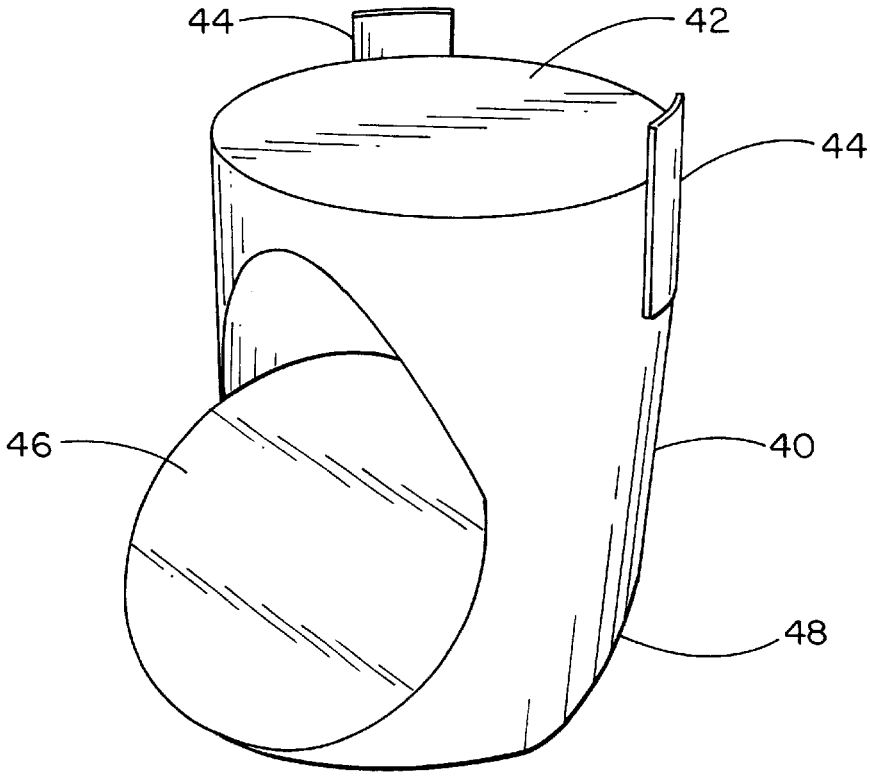
Figure 9A:
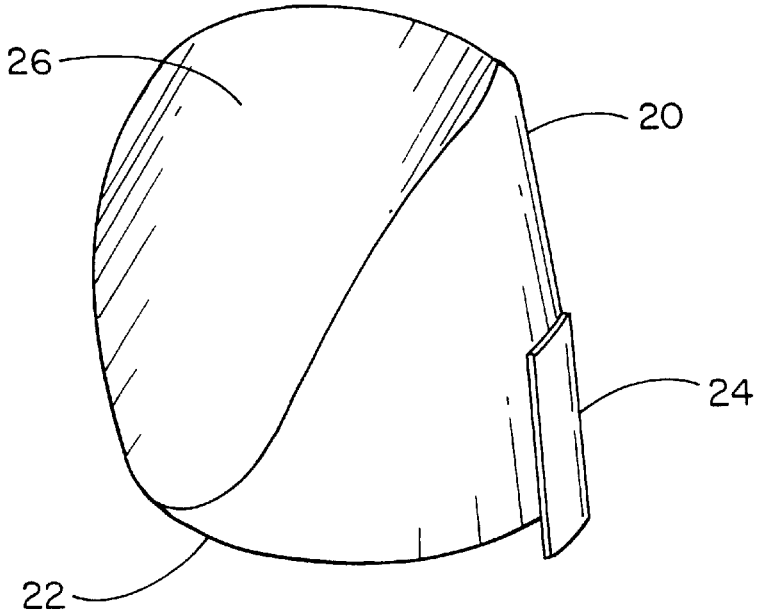
Figure 9B:
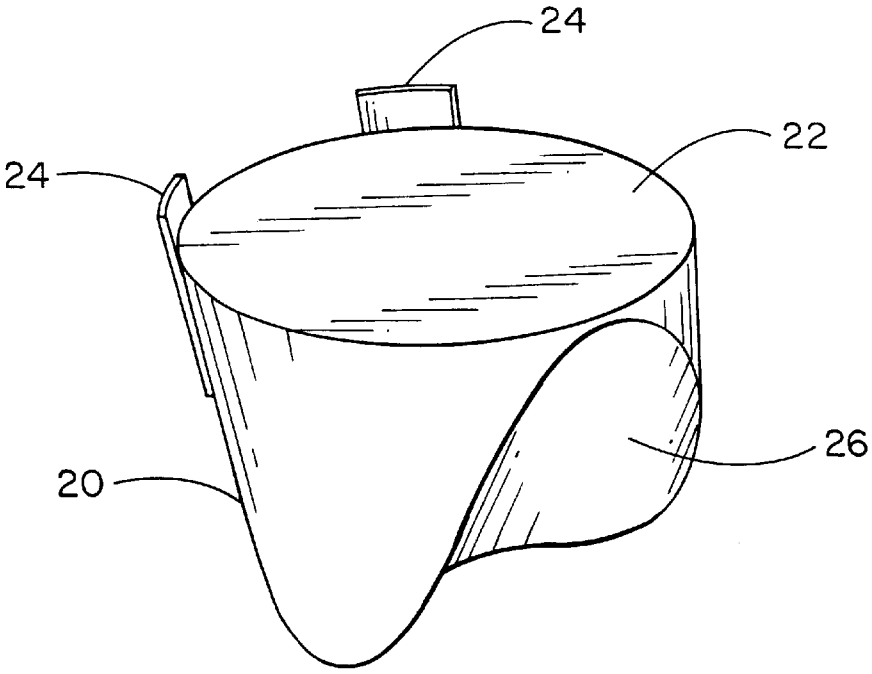

FIG. 1 a view of the invention assembly.

FIG. 2*a–d* are four different views of the saddle component.

FIG. 3*a–b* are two different perspective views of the shoe component.

Figure 4A:
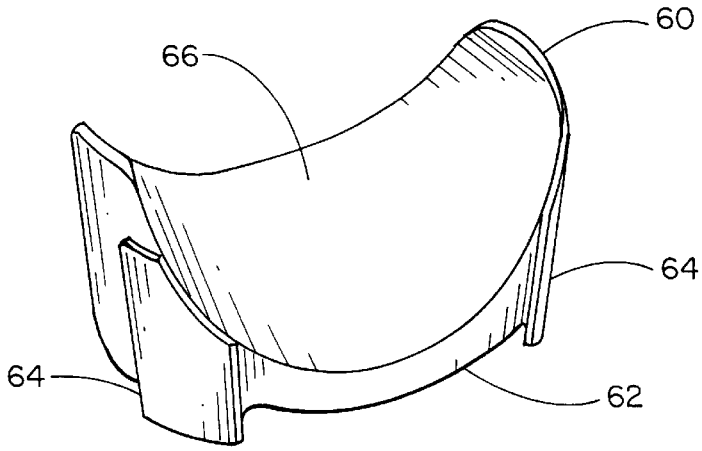
Figure 4B:
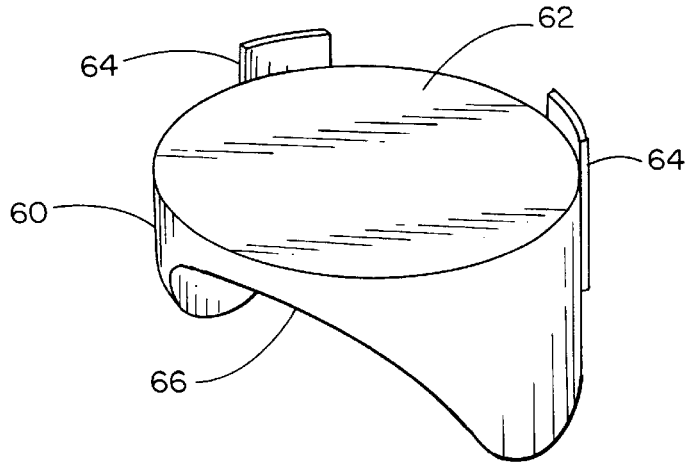

FIG. 4*a–b* are two different perspective views of the tie component.

Figure 5:
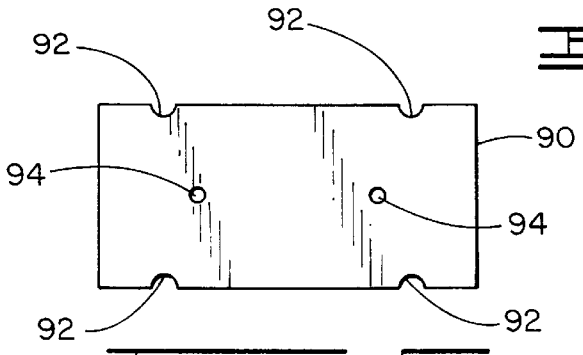

FIG. 5 is a drawing of the cinch bracket.

IV. DESCRIPTION OF THE PREFERRED EMBODIMENT

The invention 10, as shown in FIGS. 1–5 of the drawings, is an assembly of components utilized in the stabilized and firm setting and placement of corner or stretch fencing posts, comprising a shoe component 20, a saddle component 40, a tie component 60, a draw wire 80, and a cinch bracket 90.

The shoe component 20, as shown in FIGS. 1 and 3*a–b* of the drawings, is a relatively cylindrical, solid molded component having a shoe face 22, shoe post retaining tabs 24, and an angled seating groove 26. It is the lowest mounted component on a first vertical fencing post 30, and is the first component applied. Once applied, a first end 52 of a length of an angled brace post 50 is place on the shoe face 22, resting on the shoe post retaining tabs 24, at an upward angle towards a second vertical fencing post 32.

The saddle component 40, as shown in FIGS. 1 and 2*a–d* of the drawings, is the second applied component. It is a relatively cylindrical, solid molded component having a first saddle face 42, within which a second end 54 of the length of angled brace post 50 is placed, saddle post retaining tabs 44 to support the angled brace post 50, and a second saddle face 46 situated on a horizontal plane, also having saddle post retaining tabs 44, which support a first end 72 of a horizontal brace post 70. The saddle component 40 also has an angled seating groove 48, formed for secure abuttment to the second vertical fencing post 32.

The tie component 60, as shown in FIGS. 1 and 4*a–b* of the drawings, is a relatively cylindrical, solid molded component having a tie face 62, upon which a second end 74 of the horizontal brace post 70 is placed. It is the third applied component of the invention 10. Tie post retaining tabs 64 support the second end 74 of the horizontal brace post 70 within the tie face 62. A vertical seating groove 66 is present within the tie component 60 wherein the tie component 60 is abutted against the first vertical fencing post 30 at a location on the first vertical fencing post 30 well above the shoe component 20.

The draw wire 80 is a circular length of stiff wire which is loosely looped around the first vertical fencing post 30 and the second vertical fencing post 32 in the shape of a figure eight. At a crossing location 82 of the draw wire 80, the cinch bracket 90 is applied. The cinch bracket 90, as shown in FIG. 5 of the drawings, has at least two wire grooves 92, within which the draw wire 80 is placed. The cinch bracket 90 has at least one nail anchor hole 94 between the wire grooves 92. Once applied to the draw wire 80, the cinch bracket 90 and draw wire 80 are twisted, shortening the length of draw wire 80 until the angled brace post 50 and horizontal brace post 70 are immovably secured between the first vertical fencing post 30 and second vertical fencing post 32. The cinch bracket 90 is then attached to the horizontal brace post 70 to maintain the length of the draw wire 80 after being twisted.

The invention 10 includes not only the above disclosed components, but also the method of assembly. For a stretch post, as shown in FIG. 1 of the drawings, one set of the invention 10 is utilized. For a corner post, two sets of the invention 10 are utilized in a perpendicular configuration. The shoe component 20, saddle component 40, tie component 60 and cinch bracket 90 may be made of a high carbonized plastic, fiberglass, metal, ceramic, or any other non-deformable material. The draw wire 80 is made of a heavy gauge wire of sufficient tensile strength to apply enough tension to the assembled components to securely hold them together and to withstand the forces applied by multiple strands of stretched fencing wire, panels or rails.

What is claimed is:

1. A set of components for the placement and support between a first vertical fencing post and a second vertical fencing posts, the invention comprising:

a. a shoe component attaching to the first vertical fencing post;

b. a saddle component attaching to the second vertical fencing post;

c. a tie component attaching to the first vertical post above the shoe component;

d. an angled brace post between the shoe component and the saddle component;

g. a horizontal brace post between the tie component and the saddle component;

d. a draw wire attached to the first vertical fencing post and the second vertical fencing post, twisted to shorten the length of the draw wire until the angled brace post and horizontal brace post are immovably secured between the first vertical fencing post and second vertical fencing post; and e. a cinch bracket attaching to the twisted draw wire, securing the draw wire to the horizontal brace post.

2. The invention as disclosed in claim 1, further comprising:

a. the shoe component having a face, retaining tabs and a seating groove;

b. the saddle component having a first saddle face, retaining tabs, a second saddle face and an angled seating groove;

c. the tie component having a tie face, retaining tabs and a vertical seating groove;

d. the horizontal brace post having a first end and a second end;

e. the angled brace post having a first end and a second end;

f. the cinch bracket having wire grooves and a nail anchor hole, wherein the shoe component is attached to the first vertical post along the seating groove, the first end of the angled brace post is placed in the face of the shoe component, the saddle component is attached to the second vertical post along the angled seating groove with the second end of the angled brace post in the first saddle face, the vertical seating groove of the tie component is attached to the first vertical post above the shoe component, with the second end of the horizontal brace post in the tie face of the tie component and the first end of the horizontal brace post in the second saddle face of the saddle component, the draw wire looped around the first vertical fencing post and the second vertical fencing post, the draw wire having a crossing location wherein the cinch bracket is applied, twisted and anchored to the horizontal brace post by a nail applied through the nail hole in the cinch bracket.

3. The invention as disclosed in claim 1 wherein the invention is applied to three vertical posts used as a corner fencing post.

* * * * *